US005229233A

United States Patent [19]

Riddle et al.

[11] Patent Number: 5,229,233

[45] Date of Patent: Jul. 20, 1993

[54] APPARATUS AND METHOD FOR FUSING POLYMER POWDER ONTO A FACEPLATE PANEL OF A CATHODE-RAY TUBE

[75] Inventors: George H. N. Riddle, Princeton; Robert E. Simms, Cream Ridge, both of N.J.

[73] Assignee: RCA Thomson Licensing Corp., Princeton, N.J.

[21] Appl. No.: 403,238

[22] Filed: Sep. 5, 1989

[51] Int. Cl.[5] ..... G03C 5/00

[52] U.S. Cl. ..... 430/23; 430/28; 430/29; 427/68; 427/335; 118/300

[58] Field of Search ..... 354/1; 430/23, 25, 28, 430/29; 427/236, 28, 181, 335; 118/300

[56] References Cited

U.S. PATENT DOCUMENTS 2,776,907 1/1957 Carlson ..... 117/17.5
2,965,482 12/1960 Dessauer et al. ..... 96/1
2,995,464 8/1961 Gundlach ..... 117/17.5
4,376,143 3/1983 Lehman ..... 427/236
4,921,767 5/1990 Datta et al. ..... 430/23
5,028,501 7/1991 Ritt et al. ..... 430/23

*Primary Examiner*—Marion E. McCamish
*Assistant Examiner*—S. Rosasco
*Attorney, Agent, or Firm*—Joseph S. Tripoli; Dennis H. Irlbeck; Vincent J. Coughlin, Jr.

[57] ABSTRACT

An apparatus for fusing a polymer powder deposited on a surface of a faceplate panel of a cathode-ray tube comprises a housing having a faceplate support surface and enclosing a chamber. A shutter adjacent to the panel support surface separates the faceplate panel from the chamber. A reservoir for holding a solvent is within the chamber and at least one piezoelectric transducer communicates with the reservoir for atomizing the solvent to create a fog. A fan within the chamber distributes the fog onto the polymer powder. A method for fusing the polymer powder onto the faceplate panel also is described.

2 Claims, 3 Drawing Sheets

DEPOSIT
D.C. VOLTS
CHARGE
EXPOSE
DEVELOP
PHOSPHORS OR BLACK MATRIX
POWDERED FILMING RESIN
FILM
18
32
34
36
38
40
42
22
23
25

APPARATUS AND METHOD FOR FUSING POLYMER POWDER ONTO A FACEPLATE PANEL OF A CATHODE-RAY TUBE

The invention relates to an apparatus and method for fusing polymer powder onto a faceplate panel of a cathode-ray tube (CRT), and particularly to an apparatus and method for atomizing or fogging a solvent and contacting the polymer powder with the atomized solvent to soften the polymer.

BACKGROUND OF THE INVENTION

U.S. Pat. No. 4,917,978 issued to P. M. Ritt et al., entitled, METHOD OF ELECTROPHOTOGRAPHICALLY MANUFACTURING A LUMINESCENT SCREEN ASSEMBLY HAVING INCREASED ADHERENCE FOR A CRT, discloses contacting dry-powdered phosphor particles, which have been surface-treated with a suitable polymer, with a solvent, to render the phosphor materials and an underlying photoconductive layer tacky to improve the adherence therebetween. Vapor soaking is described as the method of contacting the polymer-treated phosphor particles. Vapor soaking is achieved by positioning a particle-coated faceplate below a solvent-filled container which emits solvent vapors, which are heavier than air and thus flow downwardly to soak and soften the polymer on the phosphor particles as well as the underlying photoconductive layer. The faceplate is positioned upwardly, i.e., with the concave, particle-coated surface directed towards the container so that gravitational force can be utilized to increase the adherence of the softened particles to the photoconductive layer. A drawback of vapor soaking is that between 4 and 24 hours are required for the vapor soaking step.

U.S. Pat. No. 5,028,501, issued to Ritt et al., on Jul. 2, 1991, describes a "dry" filming process which includes the steps of depositing an electrostatically-charged, dry-powdered polymeric filming resin onto previously deposited screen structure materials, and then fusing the resin to form a substantially continuous film layer. The fusing step can be accomplished by heating the dry-powdered resin or by exposing the resin to a solvent. Three solvent exposure processes are recited: fogging, vapor deposition (soaking), and direct spray. Vapor soaking is described in the above-referenced patent application Ser. No. 299,507. While vapor soaking is the slowest of the three solvent exposure methods, it is the gentlest and least likely to disturb the polymer particles on the screen. A direct spray method is the fastest, but it tends to displace the polymer particles. The preferred vapor exposure process is atomizing or fogging, which combines the speed of the spray with the gentleness of the vapor soak. A need thus exists for an apparatus and method to perform fusing of polymer powders by fogging or atomizing a solvent.

SUMMARY OF THE INVENTION

In accordance with the present invention, an apparatus for fusing a polymer powder deposited on a surface of a faceplate panel of a cathode-ray tube comprises a housing having a faceplate panel support surface and enclosing a chamber. A reservoir for holding a solvent is within the chamber, and atomizing means communicates with the reservoir for subdividing the solvent to create a fog. Circulating means within the chamber distributes the fog onto the polymer powder. A method for fusing the polymer powder onto the faceplate panel also is described.

DETAILED DESCRIPTION OF THE PREFERRED EMBODIMENT

Figure 1:
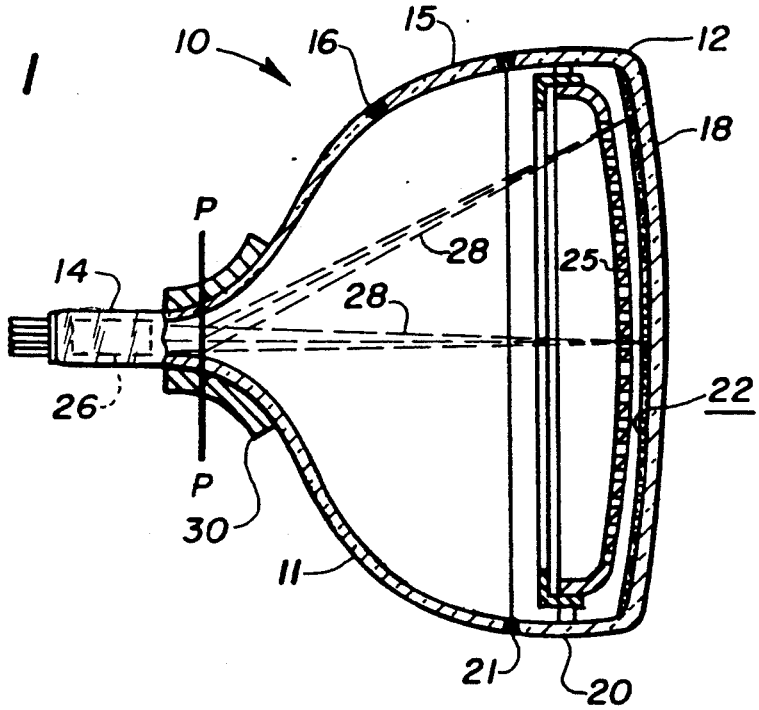
FIG. 1 is a plan view, partially in axial section, of a color cathode-ray tube made according to the present invention.
Figure 2:
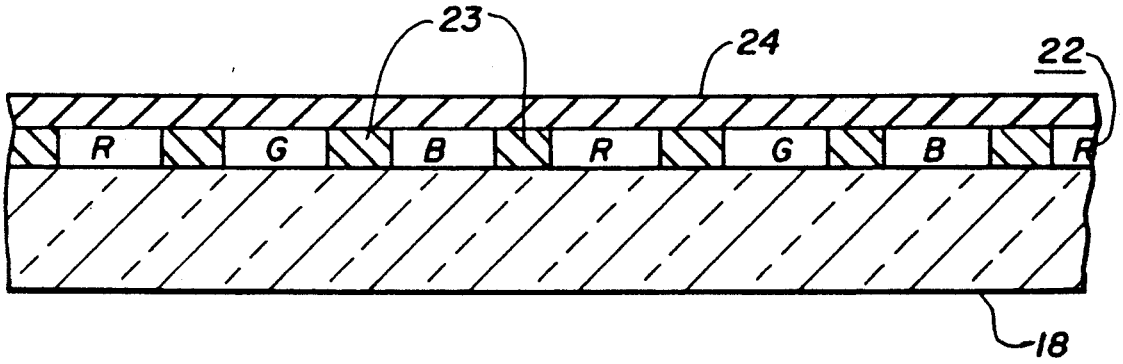
FIG. 2 is a section of a screen assembly of the tube shown in FIG. 1.

FIG. 1 shows a color CRT 10 having a glass envelope 11 comprising a rectangular faceplate panel 12 and a tubular neck 14 connected by a rectangular funnel 15. The funnel 15 has an internal conductive coating (not shown) that contacts an anode button 16 and extends into the neck 14. The panel 12 comprises a viewing faceplate or substrate 18 and a peripheral flange or sidewall 20, which is sealed to the funnel 15 by a glass frit 21. A three color phosphor screen 22 is carried on the inner surface of the faceplate 18. The screen 22, shown in FIG. 2, preferably is a line screen which includes a multiplicity of screen elements comprised of red-emitting, green-emitting and blue-emitting phosphor stripes R, G and B, respectively, arranged in color groups or picture elements of three stripes or triads in a cyclic order and extending in a direction which is generally normal to the plane in which the electron beams are generated. In the normal viewing position of the embodiment, the phosphor stripes extend in the vertical direction. Preferably, the phosphor stripes are separated from each other by a light-absorptive matrix material 23, as is known in the art. Alternatively, the screen can be a dot screen. A thin conductive layer 24, preferably of aluminum, overlies the screen 22 and provides a means for applying a uniform potential to the screen, as well as for reflecting light, emitted from the phosphor elements, through the faceplate 18. The screen 22 and the overlying aluminum layer 24 comprise a screen assembly.

A multi-apertured color selection electrode or shadow mask 25 is removably mounted, by conventional means, in predetermined spaced relation to the screen assembly. An electron gun 26, shown schematically by the dashed lines in FIG. 1, is centrally mounted within the neck 14, to generate and direct three electron beams 28 along convergent paths, through the apertures in the mask 25, to the screen 22. The gun 26 may be, for example, a bi-potential electron gun of the type described in U.S. Pat. No. 4,620,133, issued to Morrell et al., on Oct. 28, 1986, or any other suitable gun.

The tube 10 is designed to be used with an external magnetic deflection yoke, such as yoke 30 located in the region of the funnel-to-neck junction. When activated, the yoke 30 subjects the three beams 28 to magnetic fields which cause the beams to scan horizontally and vertically in a rectangular raster over the screen 22. The initial plane of deflection (at zero deflection) is shown by the line P—P in FIG. 1, at about the middle of the yoke 30. For simplicity, the actual curvatures of the deflection beam paths in the deflection zone are not shown.

The screen 22 may be manufactured by a conventional wet slurry process or, preferably, by an electrophotographic process that is schematically represented in FIGS. 3*a* through 3*f* and described in the above-referenced U.S. patent application, Ser. No. 365,877. Initially, the panel 12 is washed with a caustic solution, rinsed with water, etched with buffered hydrofluoric acid and rinsed once again with water, as is known in the art. For a screen 22 manufactured by the electrophotographic process, the inner surface of the viewing faceplate 18 is then coated with a layer 32 of electrically conductive material which provides an electrode for an overlying photoconductive layer 34. The composition and method of forming the conductive layer 32 and the photoconductive layer 34 are described in U.S. Pat. No. 4,921,767 issued to P. Datta et al. on May 1, 1990, and incorporated by reference herein for the purpose of disclosure.

Figures 3A, 3B, 3C, 3D, 3E, 3F:
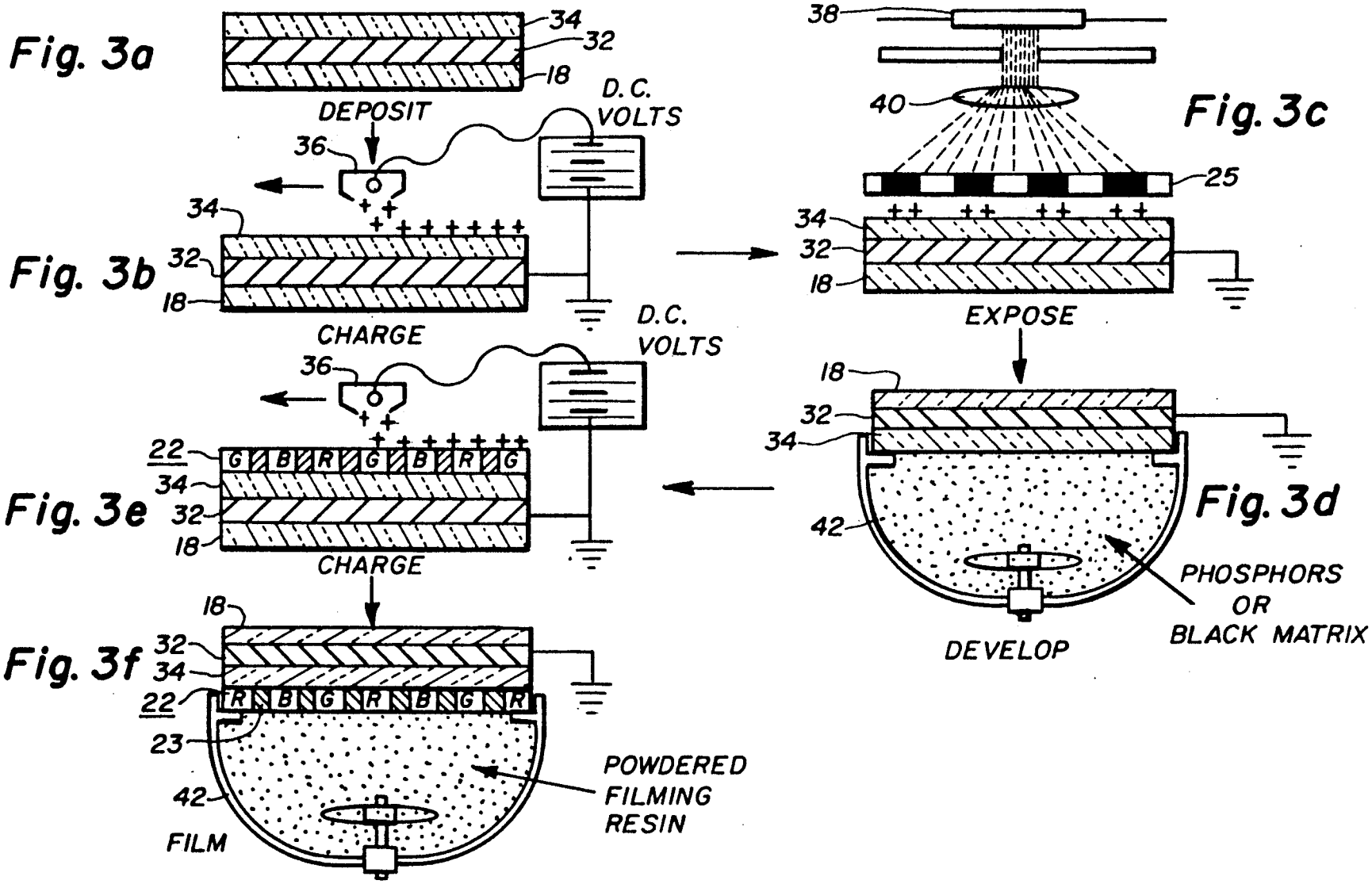
FIGS. 3*a*–3*f* show selected steps in the manufacture of the tube shown in FIG. 1.

The photoconductive layer 34 overlying the conductive layer 32 is charged in a dark environment by a conventional positive corona discharge apparatus 36, schematically shown in FIG. 3*b*, which moves across the layer 34 and charges it within the range of +200 to +700 volts. The shadow mask 25 is inserted in the panel 12, and the positively-charged photoconductor is exposed, through the shadow mask, to the light from a xenon flash lamp 38 disposed within a conventional lighthouse (represented by lens 40 of FIG. 3*c*). After each exposure, the lamp is moved to a different position, to duplicate the incident angle of the electron beams from the electron gun. Three exposures are required, from three different lamp positions, to discharge the areas of the photoconductor where the light-emitting phosphors subsequently will be deposited to form the screen. After the exposure step, the shadow mask 25 is removed from the panel 12, and the panel is moved to a first developer 42 (FIG. 3*d*). The first developer contains suitably prepared, triboelectrically charged, dry-powdered particles of a light-absorptive black matrix screen structure material.

Suitable black matrix materials generally contain black pigments which are stable at a tube processing temperature of 450° C. Black pigments suitable for use in making matrix materials include: iron manganese oxide, iron cobalt oxide, zinc iron sulfide and insulating carbon black. The black matrix material is prepared by melt-blending the pigment, a polymer and a suitable charge control agent which controls the magnitude of the triboelectric charge imparted to the matrix material. The material is ground to an average particle size of about 5 microns.

The black matrix material is triboelectrically charged, e.g., negatively, in the developer 42 by the method described in the above referenced U.S. Pat. No. 4,921,767. The negatively-charged matrix particles are expelled from the developer 42 and attracted to the positively-charged, unexposed area of the photoconductive layer 34 to directly develop that area. Preferably, the matrix particles are fused to the photoconductive layer 34 as described in the above-referenced U.S. Pat. No. 4,917,978.

The photoconductive layer 34, containing the matrix 23, is uniformly recharged by apparatus 36 to a positive potential, as described above, for the application of the first of three triboelectrically charged, dry-powdered, color-emitting phosphor screen structure materials. Although non-surface-treated phosphor materials are preferred for their higher emission efficiency, surface-treated phosphor materials, as described in the U.S. Pat. No. 4,921,767 issued to P. Datta et al. on May 1, 1990 and U.S. patent application Ser. No. 287,358, entitled, SURFACE TREATMENT OF PHOSPHOR PARTICLES AND METHOD FOR A CRT SCREEN, by P. Datta et al., filed on Dec. 21, 1988, may be utilized. The shadow mask 25 is reinserted into the panel 12, and selected areas of the photoconductive layer 34, corresponding to the locations where green-emitting phosphor material will be deposited, are exposed to actinic light from a first location within the lighthouse, to selectively discharge the exposed areas. The first light location approximates the incidence angle of the green phosphor-impinging electron beam. The shadow mask 25 is removed from the panel 12, and the panel is moved to a second developer 42. The second developer contains, e.g., triboelectrically positively-charged, dry-powdered particles of green-emitting phosphor screen structure material. The positively-charged, green-emitting phosphor particles are expelled from the developer, repelled by the positively-charged areas of the photoconductive layer 34 and matrix 23, and deposited onto the discharged, light exposed areas of the photoconductive layer, in a process known as reversal developing.

The processes of charging, exposing and developing are repeated for the dry-powdered, blue- and red-emitting, phosphor particles of screen structure material. The exposure to light, to selectively discharge the positively-charged areas of the photoconductive layer 34, is made from a second and then from a third position within the lighthouse, to approximate the incidence angles of the blue phosphor- and red phosphor-impinging electron beams, respectively. The triboelectrically positively-charged, dry-powdered phosphor particles are expelled from a third and then a fourth developer 42, repelled by the positively-charged areas of the previously deposited screen structure materials, and deposited onto the discharged areas of the photoconductive layer 34, to provide the blue- and red-emitting phosphor elements, respectively.

The screen structure materials, comprising the surface-treated black matrix material and the green-, blue-, and red-emitting phosphor particles are electrostatically attached, or bonded, to the photoconductive layer 34. The adherence of the screen structure materials can be increased by directly depositing thereon a dry-powdered filming resin from a fifth developer 42 (FIG. 3*f*). Preferably, the filming resin is electrostatically charged as follows. The conductive layer 32 is grounded during the deposition of the resin. A substantially uniform positive potential within the range of 200 to 700 volts may be applied to the photoconductive layer and to the overlying screen structure materials using the apparatus 36 (FIG. 3*e*), prior to the filming step, to provide an attractive potential and to assure a uniform deposition of the resin, which, in this instance, would be negatively-charged. The developer 42 may include, for example, an electrostatic corona gun which charges the resin particles. The resin is an organic polymer material with a low glass transition temperature/melt flow index of less than about 120° C., and with a pyrolyzation temperature of less than about 400° C. The resin preferably has an irregular particle shape for better charge distribution, and has a particle size of less than about 50 microns. The preferred material is n-butyl methacrylate; however, other acrylic resins and methyl methacrylates have been successfully utilized. Between about 1 and 10 grams, and typically about 2 grams, of the polymer powder filming resin (not shown) is deposited onto the screen surface 22 of the faceplate 18.

The polymer powder is fused into a substantially continuous film 46 by exposing the deposited material to a suitable solvent such as acetone (which is preferred for use with n-butyl methacrylate), chlorobenzene, toluene, methyl ethyl ketone (MEK), or methyl isobutyl ketone (MIBK). The solvent exposure can be achieved either by fogging, vapor deposition, or by direct spray means. The solvent method provides a more uniform film layer 46 than an alternative heating method described in the above-referenced U.S. patent application, Ser. No. 5,028,501; however, special handling and venting are required when solvent fusing of the film is utilized. Of the three solvent exposure methods for fusing the film, vapor deposition is the slowest, but gentlest and least likely to disturb the filming resin and underlying screen structure materials. The direct spray method of solvent exposure is fast and does not require complex equipment; however, it tends to displace the underlying screen structure materials. Fogging is the preferred solvent exposure method, because it optimizes the process by combining the speed of the spray with the gentleness of the vapor.

Figure 4:
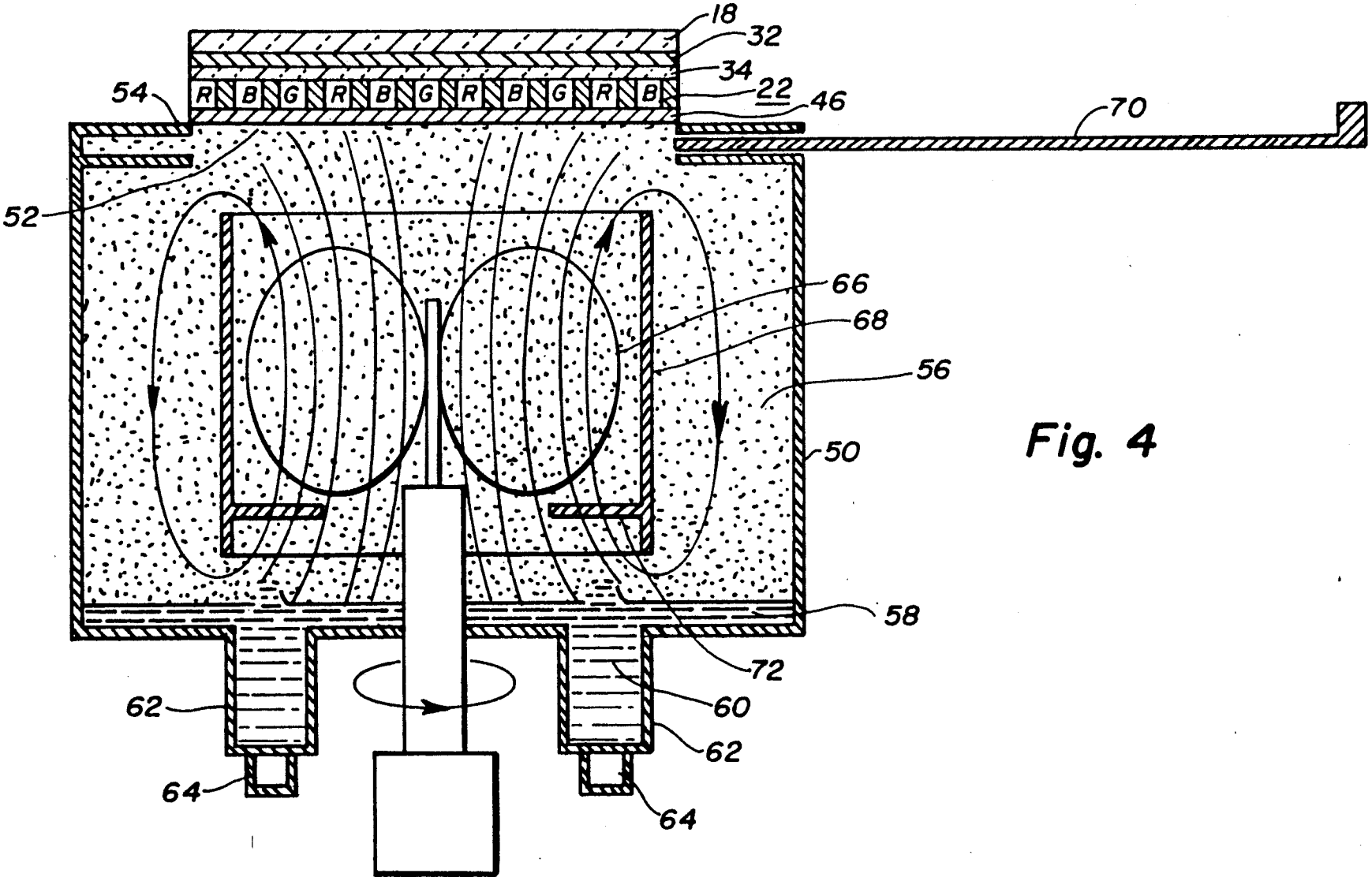
FIG. 4 shows an apparatus for performing a novel fusing operation in yet another step in the manufacture of the tube shown in FIG. 1.

A novel fogging apparatus is shown in FIG. 4 and comprises a box-like, substantially enclosed housing 50 which has an opening 52 at one end, e.g., the top. The opening 52 is circumscribed by a perimetrical faceplate panel support surface 54. The housing 50 encloses a chamber 56, the lower portion of which comprises a reservoir 58 which contains a suitable quantity of a solvent 60 such as acetone. At least one, and preferably four, wells 62 are provided within the housing 50. A piezoelectric transducer 64 is attached to the bottom exterior surface of each of the wells 62, to provide a means for communicating with and atomizing the solvent 60 within the reservoir 58, to create a fog. Atomizing is defined as the mechanical subdivision of a bulk liquid, e.g., the solvent, to produce drops which vary in size from between about 0.1 to 1.0 micrometer. A fan 66 for distributing the fog of atomized solvent is centrally disposed within the chamber 56. The fan 66 is upwardly directed and surrounded by a cylindrical fan duct 68, which assists in directing the fog toward the opening 52 in the top of the housing 50. A shutter 70, shown in the open position, is located within the housing 50, adjacent to the panel support surface 54, to separate the faceplate panel 12 from the chamber 56. A plurality of splatter shields 72, one overlying each of the wells 62, are attached to the fan duct 68, to prevent large droplets of solvent from splattering on the polymer powder overlying the screen 22 on the faceplate panel 12.

During the fusing of the polymer powder, the shutter 70 is initially closed and a faceplate panel 12, processed in the manner described above and represented by FIGS. 3*a*–3*f*, is positioned on the support surface 54, with the screen-side covering the opening 52 in the housing 50. The transducers 64 are energized to atomize the solvent 60 and create a fog which is directed upwardly by the fan 66. The shutter 70 is then opened to permit the fog of solvent to contact the polymer powder, e.g., the filming resin, on the interior surface of the faceplate 18. When the fog contacts the filming resin, the fog condenses, dissolves the polymeric material and causes it to flow and form the film 46. The shutter 70 is then closed, and the panel 12 is removed from the support surface 54. The atomized solvent within the chamber condenses on the surfaces of the shutter and the housing and is returned to the reservoir 58 to be reused.

The film 46 is water insoluble and acts as a protective barrier, if a subsequent wet-filming step is required to provide additional film thickness or uniformity. If sufficient dry-filming resin is utilized, the subsequent wet-filming step is unnecessary. Subsequently, an aqueous 2 to 4 percent, by weight, solution of boric acid or ammonium oxalate is oversprayed onto the film 46, to form a ventilation-promoting coating (not shown). Then, the panel is aluminized, as is known in the art, and baked at a temperature of about 425° C. for about 30 to 60 minutes or until the volatilizable organic constituents are driven from the screen assembly. The ventilation-promoting coating begins to bake-out at about 185° C. and produces small pin holes in the aluminum layer, which facilitate removal of the organic constituents without blistering the aluminum layer.

While the fogging apparatus is designed primarily to fuse the polymeric filming resin, it also may be used after each of the matrix and phosphor deposition steps to fuse the polymer constituents of the surface-treated screen structure materials, i.e., the matrix and phosphor particles, to the faceplate.

What is claimed is:

1. A method for fusing a polymer powder onto a faceplate panel of a cathode-ray tube using a fogging apparatus comprising a housing having a faceplate panel support surface, a chamber enclosed within said housing, said chamber including a reservoir for holding a solvent, atomizing means, communicating with said reservoir, for subdividing said solvent to form a fog, circulating means, within said chamber, for distributing said fog onto said polymer powder on said faceplate and shielding means within said chamber to prevent large droplets of solvent from contacting said polymer powder, said method including the steps of a) positioning said faceplate panel having the polymer powder thereon on said faceplate panel support surface of said housing, b) energizing said atomizing means to subdivide said solvent to create said fog, and c) activating said circulating means to distribute said fog onto said polymer powder, thereby dissolving and fusing said polymer powder.

2. A method for fusing a polymer powder onto a faceplate panel of a cathode-ray tube using a fogging apparatus comprising a housing enclosing a chamber, said housing having a faceplate panel support surface with a shutter adjacent thereto to separate said faceplate panel from said chamber, said chamber including a reservoir for holding a solvent, at least one transducer communicating with said reservoir, for subdividing said solvent to form a fog, a fan, within said chamber, for distributing said fog onto the polymer powder on said faceplate and at least one splatter shield within said chamber to prevent large droplets of solvent from contacting the polymer powder, said method including the steps of a) positioning said faceplate panel, having the polymer powder thereon, on said faceplate panel support surface of said housing, b) energizing said transducer to subdivide said solvent, to create said fog, c) activating said fan, and d) opening said shutter to permit said fog to contact and condense on said polymer powder, thereby dissolving and fusing said polymer powder.

* * * * *

UNITED STATES PATENT AND TRADEMARK OFFICE

CERTIFICATE OF CORRECTION

PATENT NO. : 5,229,233

DATED : July 20, 1993

INVENTOR(S) : George H. N. Riddle et al.

It is certified that error appears in the above-identified patent and that said Letters Patent is hereby corrected as shown below:

Col. 1, lines 47-48,
"patent application Ser. No.
299,507" should read --Patent
No. 4,917,978--.

Col. 5, lines 12-13,
"patent application Ser."
should read --Patent--.

Col. 5, line 55, after "closed"
add --,--.

UNITED STATES PATENT AND TRADEMARK OFFICE

CERTIFICATE OF CORRECTION

PATENT NO. : 5,229,233

DATED : July 20, 1993

INVENTOR(S) : George H. N. Riddle et al.

It is certified that error appears in the above-identified patent and that said Letters Patent is hereby corrected as shown below:

Col. 3, line 5, change "patent application Ser. No. 365,877" to --Pat. No. 5,028,501--.

Signed and Sealed this

Twelfth Day of October, 1993

Bruce Lehman

*Attest:*

BRUCE LEHMAN

*Attesting Officer*

*Commissioner of Patents and Trademarks*